US007095394B2

(12) United States Patent
Hong

(10) Patent No.: US 7,095,394 B2
(45) Date of Patent: Aug. 22, 2006

(54) DRIVING DEVICE OF LIQUID CRYSTAL DEVICE AND DRIVING METHOD THEREOF

(75) Inventor: Hyung-Ki Hong, Seoul (KR)

(73) Assignee: LG. Philips LCD Co., Ltd., Seoul (KR)

( * ) Notice: Subject to any disclaimer, the term of this patent is extended or adjusted under 35 U.S.C. 154(b) by 245 days.

(21) Appl. No.: 10/326,296

(22) Filed: Dec. 23, 2002

(65) Prior Publication Data

US 2003/0122761 A1 Jul. 3, 2003

(30) Foreign Application Priority Data

Dec. 31, 2001 (KR) ..... 10-2001-0089296

(51) Int. Cl.
*G09G 3/36* (2006.01)

(52) U.S. Cl. ..... 345/89; 345/88; 345/690

(58) Field of Classification Search ..... 345/87–89, 345/98–100, 103, 690, 694
See application file for complete search history.

(56) References Cited

U.S. PATENT DOCUMENTS 5,345,265 A * 9/1994 Kim ..... 348/254
5,499,037 A * 3/1996 Nakagawa et al. ..... 345/89
6,160,532 A * 12/2000 Kaburagi et al. ..... 345/87
6,243,059 B1 * 6/2001 Greene et al. ..... 345/88
6,429,841 B1 * 8/2002 Lee ..... 345/89
6,593,934 B1 * 7/2003 Liaw et al. ..... 345/590
6,806,853 B1 * 10/2004 Park et al. ..... 345/82
2002/0063666 A1 * 5/2002 Kang et al. ..... 345/87
2002/0126077 A1 * 9/2002 Baek, Il ..... 345/87
2002/0163490 A1 * 11/2002 Nose ..... 345/89
2003/0006952 A1 * 1/2003 Hong ..... 345/89

* cited by examiner

*Primary Examiner*—Xiao Wu
(74) *Attorney, Agent, or Firm*—McKenna Long & Aldridge LLP

(57) ABSTRACT

A driving device of a liquid crystal display device includes a timing controller for receiving image information and a control signal from a graphic processor through an interface unit; a gate driver integrated circuit for receiving the control signal from the timing controller and a gate on/off power from a DC/DC converter and for supplying a scan signal to a gate pad area in a periphery of a liquid crystal panel; a data driver integrated circuit for receiving the image information and the control signal and for supplying the image information to a data pad area in a periphery of the liquid crystal panel; a first gamma voltage generator for supplying a first gamma voltage to the data driver integrated circuit in a general driving mode; and a second gamma voltage generator for supplying gamma voltages to the data driver integrated circuit in a halftone gray driving mode.

16 Claims, 5 Drawing Sheets

DRIVING DEVICE OF LIQUID CRYSTAL DEVICE AND DRIVING METHOD THEREOF

This application claims the benefit of the Korean Application No. P2001-89296 filed on Dec. 31, 2001, which is hereby incorporated by reference for all purposes as if fully set forth herein.

BACKGROUND OF THE INVENTION

1. Field of the Invention

The present invention relates to a liquid crystal display driving device and a method of driving a liquid crystal display. More particularly, the present invention relates to a driving method and device using a halftone gray driving method in enlarging an image, wherein the driving device and method are capable of enhancing viewing angle characteristics of a liquid crystal display.

2. Description of the Related Art

Generally, liquid crystal display (LCD) devices include a liquid crystal display panel having a plurality of liquid crystal cells arranged in a matrix pattern and a driver integrated circuit (IC) for driving the liquid crystal cells. Data signals containing image information are received by the driver IC and are applied to individual liquid crystal cells. Accordingly, light transmittance characteristics of the individual liquid crystal cells may be controlled by the applied data signals to display images across the LCD panel.

The liquid crystal panel generally includes a color filter substrate separated from a thin film transistor array substrate by a layer of liquid crystal material. A common electrode and pixel electrodes are formed on the opposing surfaces of the color filter and thin film transistor array substrates, respectively, and apply electric fields to the layer of liquid crystal material. The pixel electrodes are formed within liquid crystal cells on the thin film transistor array substrate and the common electrode is formed over the entire surface of the color filter substrate. By controlling voltages applied to the pixel electrodes while a voltage is applied to the common electrode, light transmittance characteristics of the individual liquid crystal cells is controlled.

The thin film transistor array substrate supports a plurality of data lines and a plurality of gate lines crossing the data lines. Liquid crystal cells are defined where the gate and data lines cross each other. The data lines transmit data signals supplied from a data driver IC to the liquid crystal cells while the gate lines transmit scan signals supplied from a gate driver IC to the liquid crystal cells.

The gate driver IC sequentially supplies a scan signal to the plurality of gate lines such that the liquid crystal cells are sequentially selected one line at a time. Data signals are supplied from the data driver IC to the liquid crystal cells within the selected line.

Switching devices such as thin film transistors are provided to control the voltage applied to the pixel electrode by liquid crystal cells. Via the gate lines, scan signals are applied to gate electrodes of the thin film transistors to form a conductive channel between a source/drain electrode of the thin film transistor within the liquid crystal cell. Via the data lines, data signals are applied to source electrodes of the thin film transistors and then to pixel electrodes to control the light transmittance characteristics of individual liquid crystal cells.

The LCD panel described above will now be explained in detail with reference to the accompanying drawings.

FIG. 1 illustrates a schematic view of a related art LCD panel including the thin film transistor array and color filter substrates attached to, and facing each other.

Referring to FIG. 1, the LCD panel 10 includes an image display area 13 having a plurality of liquid crystal cells arranged in a matrix pattern, a gate pad area 14 connected to a plurality of gate lines within the image display area 13, and a data pad area 15 connected to a plurality of data lines within the image display area 13.

The gate and data pad areas 14 and 15, respectively, are formed at peripheral portions of the thin film transistor array substrate 11 that do not overlap with the color filter substrate 12. The gate pad area 14 receives scan signals from the gate driver IC and supplies the received scan signals to the plurality of gate lines within the image display area 13. The data pad area 15 receives image information from the data driver IC and supplies the received image information to the plurality of data lines within the image display area 13.

Though not shown in FIG. 1, switching devices such as thin film transistors are formed where the plurality of gate and data lines cross each other on the thin film transistor array substrate 11 and within the image display area 13. The thin film transistors control the light transmittance characteristics of the liquid crystal cells within which they are formed. Pixel electrodes are connected to corresponding thin film transistors and drive the liquid crystal cells. A passivation film is formed over the entire surface of the thin film transistor and protects the thin film transistor.

A plurality of color filters, a black matrix, a common transparent electrode, and counter electrodes of the pixel electrodes are formed on the color filter substrate 12 and within the image display area 13. The color filters are coated within individual cell regions and separated by the black matrix.

Spacers are provided between the thin film transistor array and color filter substrates 11 and 12 to create a uniform cell gap that may be filled with liquid crystal material. The thin film transistor array and color filter substrates 11 and 12 are attached by a sealant 16 formed at a periphery of the image display area 13.

The LCD device illustrated in FIG. 1, however, has a small optical viewing angle and displays images at lower brightness levels than other display devices. Accordingly, recent LCD development seeks to increase the optical viewing angle and light transmittance characteristics.

SUMMARY OF THE INVENTION

Accordingly, the present invention is directed to an LCD driving device and method of driving an LCD that substantially obviates one or more of the problems due to limitations and disadvantages of the related art.

To achieve these and other advantages and in accordance with the purpose of the present invention, as embodied and broadly described herein, an LCD driving device includes a timing controller for receiving image information and a control signal from a graphic processor through an interface unit, a gate driver IC for receiving the control signal from the timing controller and gate on/off power from a DC/DC converter and for supplying a scan signal to a gate pad area of an LCD panel, a data driver integrated circuit for receiving the image information and the control signal from the timing controller and for supplying the image information to the data pad area of the LCD panel, and a gamma voltage generator for generating at least two gamma voltages and for supplying the generated gamma voltages to the data driver IC. A switching unit may be separately provided to selectively switch the generated gamma voltages.

In one aspect of the present invention, the gamma voltage generator may include a first gamma voltage generating circuit for generating a general mode gamma voltage and a second gamma voltage generating circuit for generating at least two halftone gray mode gamma voltages, wherein the gamma voltages generated from the second gamma voltage generating circuit may include at least one white or black level.

In another aspect of the present invention, the switching unit may receive a control signal from the timing controller for differentiating between a halftone gray driving mode and a general driving mode so that the gamma voltage generator generates a corresponding gamma voltage and applies the corresponding gamma voltage to the data driver IC.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
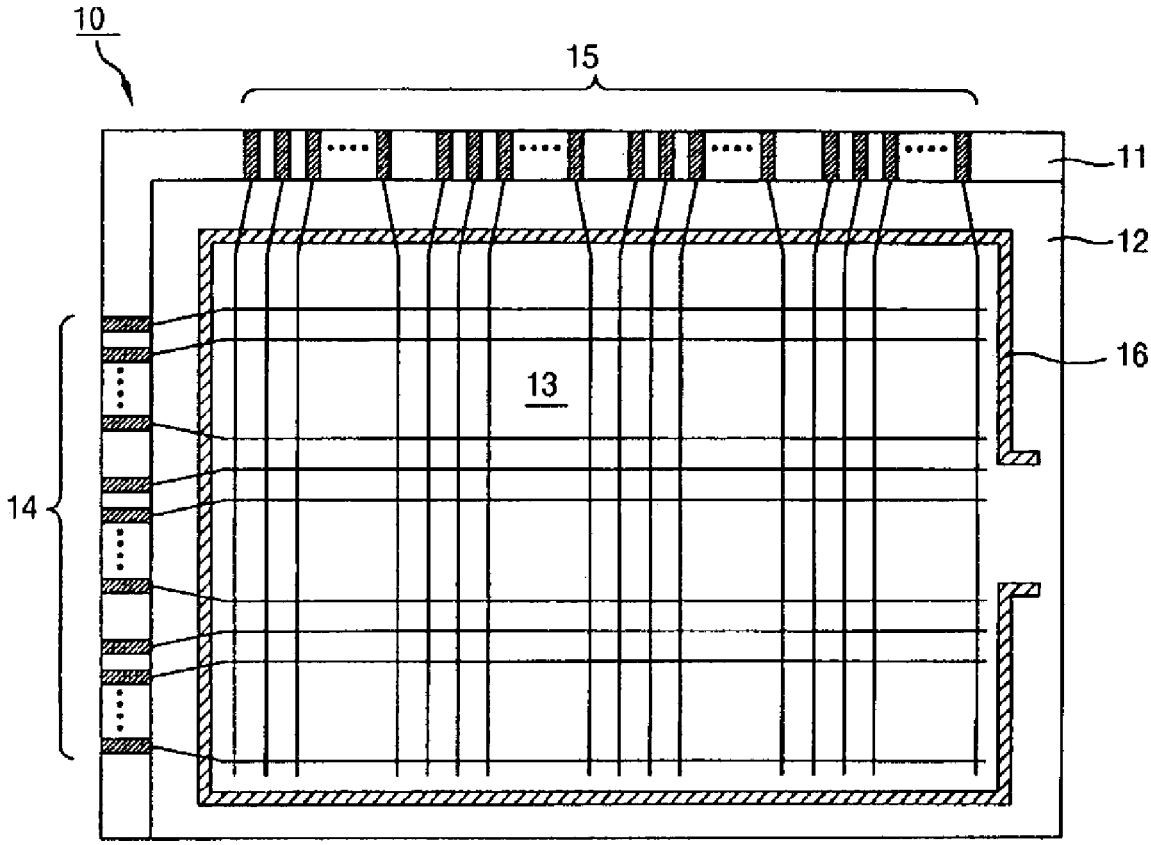
FIG. 1 BACKGROUND ART
FIG. 1 illustrates a schematic view of a related art liquid crystal display panel.
Figure 2:
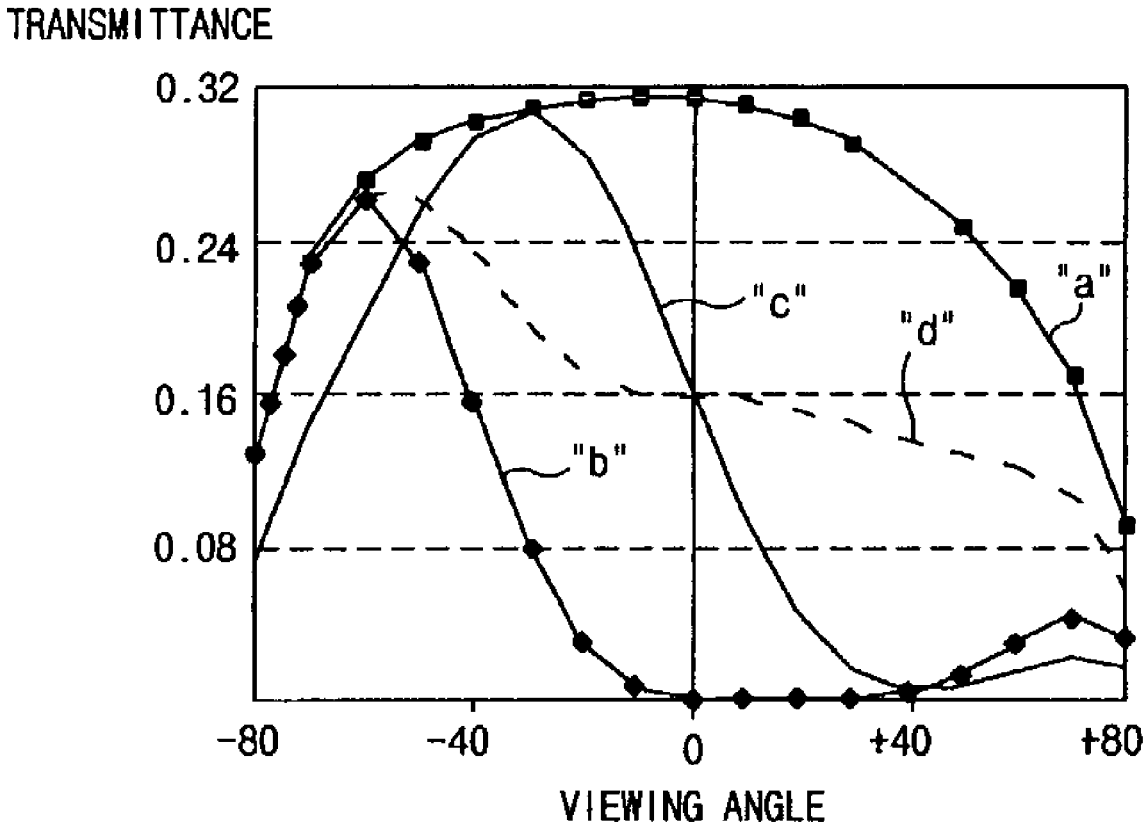
FIG. 2 illustrates a graph of viewing angle versus transmittance characteristics of a twisted nematic (TN) liquid crystal display device.

FIG. 2 illustrates a graph of a general viewing angle vs. transmittance characteristics of a twisted nematic (TN) liquid crystal display (LCD) device.

Referring to FIG. 2, curves 'a', 'b', 'c' and 'd' represent the viewing angle/transmittance characteristics for white, black, middle gray, halftone gray grayscale levels, respectively.

Curve 'a' represents the white grayscale level and exhibits excellent transmittance characteristics within a viewing angle between about −80° and about +80°. For example, a high transmittance above about 0.24 is viewable between an angle of about −60° and about +60°. Transmittance characteristics represented by curve 'a' are substantially symmetric about the 0° viewing angle. At viewing angles greater than about 60°, the transmittance characteristics of the LCD sharply deteriorate.

Curve 'b' represents the black grayscale level and exhibits very low transmittance characteristics at viewing angles beyond about −80° to about −40°.

Curve 'c' represents the middle gray grayscale level and exhibits a transmittance above about 0.16 at viewing angles in a range of about −60° to about −20°. Transmittance characteristics represented by curve 'c' are substantially symmetric about the −20° viewing angle and are generally low. Curve 'c' has a wider viewing angle than curve 'b' (the black grayscale level) but narrower than curve 'a' (the white grayscale level).

Curve 'd' represents viewing angle/transmittance characteristics when middle gray grayscale level is displayed using a halftone gray driving method. The halftone gray driving method combines the white grayscale level (curve 'a') and the black grayscale level (curve 'b'). Compared to curve 'c', curve 'd' exhibits degraded transmittance characteristics at a range of viewing angles between about −40° to about 0° but exhibits improved overall transmittance characteristics at viewing angles outside −40° and 0°. Accordingly, the viewing angle characteristics of curve 'd' may be improved while the overall transmittance is enhanced.

In one aspect of the present invention, the viewing angle of an LCD device may be improved by adopting the halftone gray driving method in the process of enlarging an image.

The halftone gray driving method may be implemented by dividing one pixel into two or more regions including a main pixel portion and a sub-pixel portion and by applying varying voltages to the layer of liquid crystal material.

Figure 3:
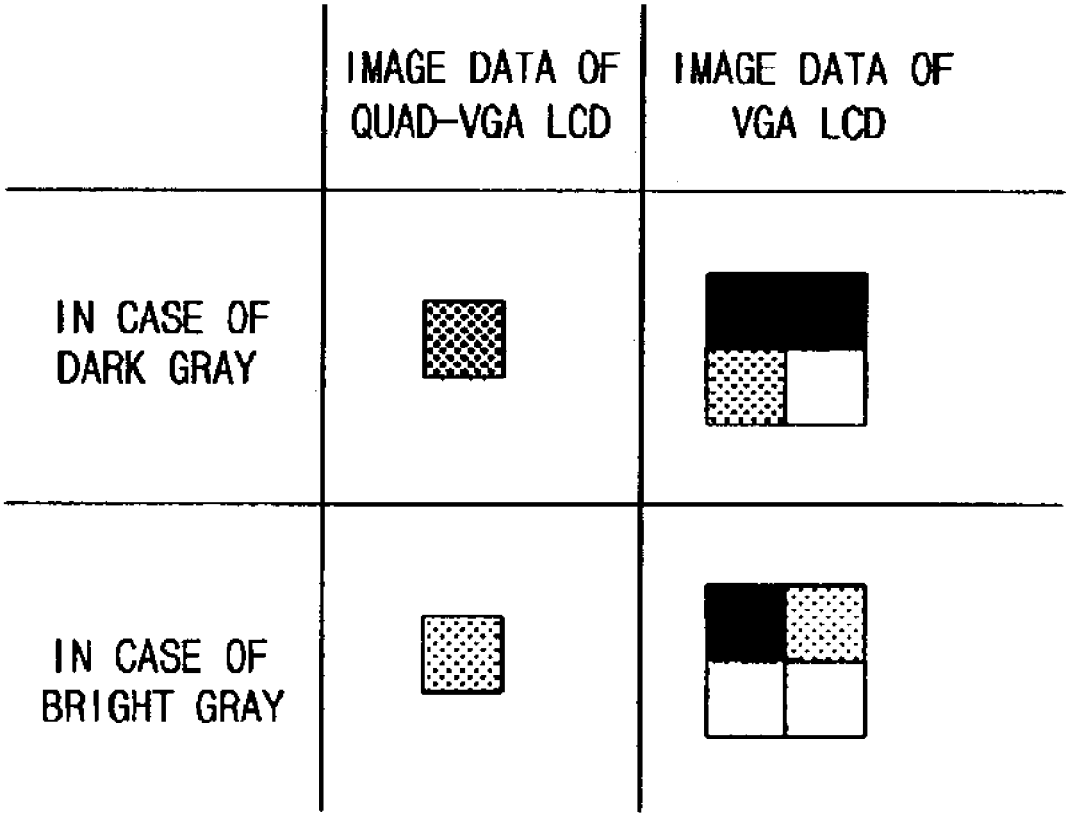
FIG. 3 illustrates brightness characteristics of pixels driven according to a halftone gray driving method.

Referring to FIG. 3, quad-VGA image information used in VGA mode displays allows a dark gray grayscale level to be displayed. One quad-VGA pixel corresponds to 4 (2×2) VGA pixels. Accordingly, a dark gray grayscale level may be displayed by simultaneously displaying a white grayscale level, having excellent viewing angle characteristics, a black grayscale level, and a gray grayscale level in each quad-VGA pixel (4 (2×2) VGA pixels). Accordingly, the average luminance value of one quad-VGA pixel is substantially equal to the average luminance value of 4 (2×2) VGA pixels. Further, images having enhanced viewing angles may be realized in VGA mode while having the same luminance value as one quad-VGA pixel.

Quad-VGA image information used in VGA mode displays allows a bright gray grayscale level to be displayed. A bright gray grayscale level having the same luminance value of a quad-VGA pixel may be displayed by simultaneously displaying a white grayscale level, having excellent viewing characteristics, a black grayscale level, and a gray grayscale level in each quad-VGA pixel.

By enlarging images as described above, the halftone gray driving method enhances the viewing angle characteristics while maintaining luminance values of low-resolution images. The halftone gray driving method may be implemented by applying different gamma voltages to each sub-pixel within a quad-VGA pixel.

The LCD driving device and method of driving the LCD according to the present invention will now be explained in greater detail.

Figure 4:
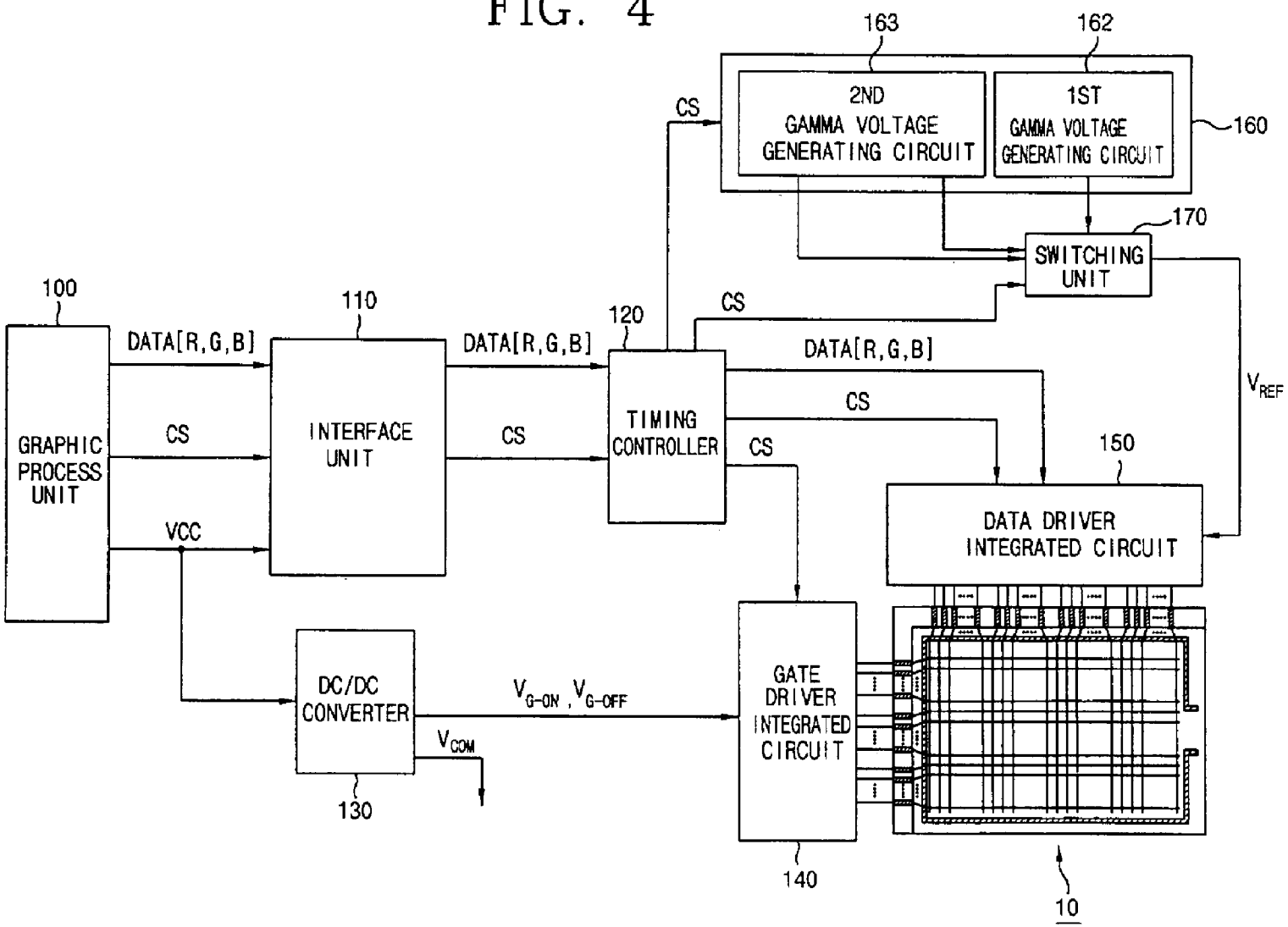
FIG. 4 illustrates a block diagram of a liquid crystal display device according to an aspect of the present invention.

FIG. 4 illustrates a block diagram of a liquid crystal display device according to an aspect of the present invention.

Referring to FIG. 4, an LCD driving device may, for example, include a timing controller 120 for receiving image information and a control signal from a graphic processor 100 through an interface unit 110; a gate driver IC 140 for receiving the control signal from the timing controller 120, for receiving a gate on/off power from a DC/DC converter 130, and for supplying a scan signal to a gate pad area in a periphery of a LCD panel 10; a data driver integrated circuit 150 for receiving the image information and the control signal from the timing controller and for supplying the image information to a data pad area in a periphery of the LCD panel 10; and a gamma voltage generator 160 for generating gamma voltages and for supplying the gamma voltages to the data driver IC, wherein the gamma voltage generator includes a first gamma voltage generating circuit 162 for generating general driving mode gamma voltages and a second gamma voltage generating circuit 163 for generating halftone gray driving mode gamma voltages. In one aspect of the present invention, the halftone gray driving method is different from the general driving mode.

The LCD driving device may also include a switching unit 170 arranged between the gamma voltage generator 160 and the data driver IC 150. The switching unit 170 may selectively activate the first gamma voltage generating circuit 162 and the second gamma voltage generating circuit 163 according to the timing control signal. The particular driving mode (e.g., the general driving mode or the halftone gray driving mode) in which the liquid crystal display device is driven may be selected by the switching unit 170. When, for example, the general driving mode is selected, first gamma voltage generating circuit 162 generates predetermined gamma voltages. When, for example, the halftone gray driving mode is selected, the second gamma voltage generating circuit 163 generates predetermined gamma voltages.

In one aspect of the present invention, the second gamma voltage generating circuit 163 may include a plurality of gamma voltage circuits capable of generating at least two gamma voltages. In another aspect of the present invention, the number of gamma voltages generated may vary depending on the size of the enlarged image.

When, for example, an image is enlarged to double its original size, two gamma voltages may be generated. When, for example, an image is enlarged to quadruple its original size, four gamma voltages may be generated. Accordingly, the second gamma voltage generating circuit 163 may generate at least one white grayscale level or black grayscale level such that the luminance value of the enlarged image is substantially the same as the luminance value of the original image.

Figure 5:
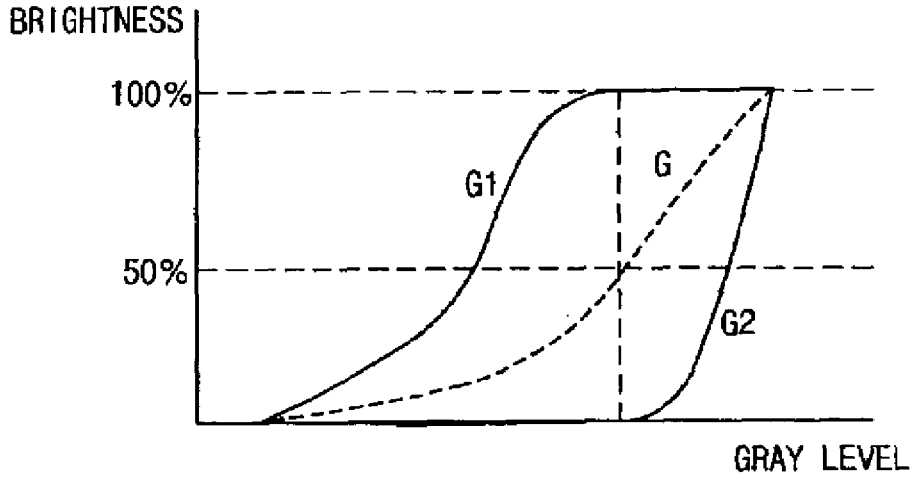
FIG. 5 illustrates a graph of the relationship between gray level and luminance when images are doubled in size.

FIG. 5 is a graph illustrating the relationship between grayscale level and luminance values when images are enlarged to double their original size.

Referring to FIG. 5, a halftone gray driving mode may be implemented in enlarging an image, originally displayed using a general driving mode and using a gamma voltage 'G', to double its original size. Accordingly, the second gamma voltage generating circuit 163 may generate first and second gamma voltages (G1) and (G2), respectively, such that an average luminance value of the enlarged image at any gray level is substantially equal to luminance value of the original image at a corresponding grayscale level.

According to the principles of the present invention, if a luminance value of an original image is below 50%, the second gamma voltage generating circuit 163 generates the second gamma voltage (G2) to express a black grayscale level having a luminance value of about 0%, and the first gamma voltage (G1) to express a grayscale value having a luminance value higher than that obtained with (G2) and 'G' such that the average luminance value expressed via (G1) and (G2) is substantially equal to the luminance value expressed via 'G'. If, however, a luminance value of an original image is above 50%, the second gamma voltage generating circuit 163 generates a first gamma voltage (G1) to express a white grayscale level having a luminance value of about 100%, and a second gamma voltage (G2) to express a grayscale level having a luminance value less than the luminance value obtained with 'G', such that the average luminance value expressed via (G1) and (G2) is substantially equal to the luminance value expressed via 'G'.

When the halftone gray driving method is used to enlarge images having luminance values less than 50% to double their original size, the enlarged images are displayed at a black grayscale level so that the viewing angle is not enhanced. However, when the luminance value of the original image is greater than 50%, the white grayscale level improves the viewing angle characteristics of the enlarged image. The viewing angle of the enlarged image may be improved because the gray grayscale level, having a luminance value of about 50%, is displayed in combination with a first gamma voltage (G1) expressing a white grayscale level and a second gamma voltage (G2) expressing a black grayscale level. If the luminance value of the original image is greater than about 50%, the gray grayscale level is displayed in combination with the first gamma voltage (G1) expressing the white grayscale level. Accordingly, as shown in the graph of FIG. 2, the white grayscale level (curve 'a') has a larger range of viewing angles compared to the other grayscale levels (curves 'b' through 'd') and use of the white grayscale level in the enlarged image improves the viewing angle characteristics of the enlarged image.

When, for example, an image is quadrupled in size, one pixel of an original image may be enlarged and displayed using four pixels. Accordingly, the second gamma voltage generating circuit 163 may generate four gamma voltages to drive the liquid crystal display device using the halftone gray driving mode.

Figure 6:
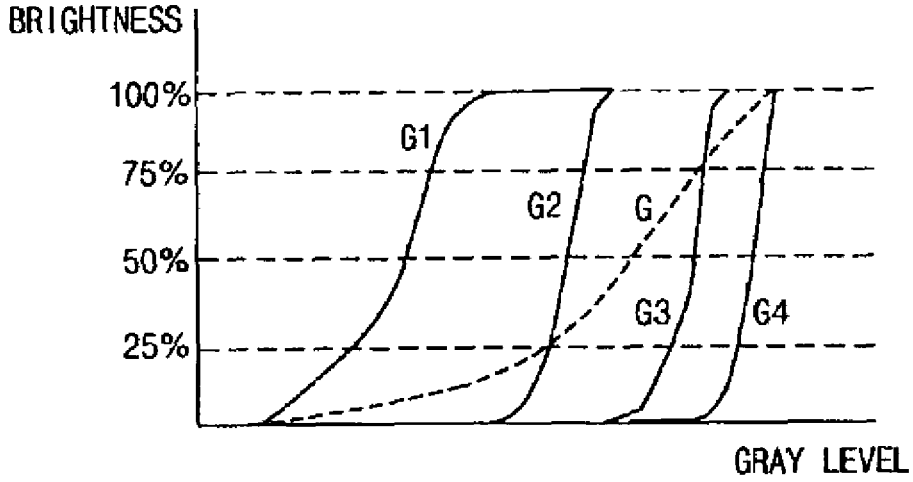
FIG. 6 illustrates a graph of the relationship between gray level and luminance when images are quadrupled in size.

Referring to FIG. 6, the second gamma generation circuit 163 may generate first to fourth gamma voltages (G1), (G2), (G3), and (G4) and combine the first to fourth gamma voltages such that the enlarged image has substantially the same luminance value of the original image generated using the original gamma voltage 'G'.

For example, to generate an enlarged image having a luminance value and grayscale level substantially the same as the original image generated using the original gamma voltage 'G' and having a luminance value of about 25%, the gamma voltage generating circuit 163 may, for example, generate a first gamma voltage (G1) representing a white grayscale level, third and fourth gamma voltages (G3, G4) representing black grayscale levels, and a second gamma voltage (G2) having a luminance less than about 25% to produce a grayscale level having an average luminance value of about 25%.

In one aspect of the present invention, an original gamma voltage producing a pixel transmitting light at a luminance value of about 50% may be equivalently represented by generating first and second gamma voltages (G1) and (G2) expressing two white grayscale levels and third and fourth gamma voltages (G3) and (G4) expressing two black grayscale levels.

In another aspect of the present invention, a luminance value of an original image is about 75%, may be equivalently represented by generating first to third gamma voltages (G1), (G2) and (G3) expressing three white grayscale levels and a fourth gamma voltage (G4) expressing a gray grayscale level. Accordingly, the values of gamma voltages (G1) to (G4) are not fixed but may vary such that the average luminance value of gamma voltages (G1) to (G4) is substantially equal to the luminance value of the original image generated by the original gamma voltage 'G' and such that the viewing angle of the enlarged image is improved.

A method of driving the LCD driving device shown in FIG. 4 will now be described.

Image information (e.g., R,G,B information) contained within a data signal and a control signal (CS) may be generated by the graphic processor 100 and applied to the timing controller 120 through the interface unit 110. A system power (Vcc) of about 3.3V may be applied from the graphic processor 100 to the timing controller 120 and the DC/DC converter 130.

The timing controller 120 supplies the control signal (CS) to the gate driver IC 140, the image information, and the control signal (CS) to the data driver IC 150. The control signal (CS) may, for example, include a clock signal, a gate start signal, and a timing signal, and may control the driving timing of the gate and data driver ICs 140 and IC 150, respectively.

Upon receiving the system power (Vcc), the DC/DC converter 130 supplies a gate ON/OFF power ($V_{G\text{-}ON}/V_{G\text{-}OFF}$) to the gate driver IC 140 and a common voltage ($V_{COM}$) to the common transparent electrode formed on the color filter substrate 12 of the LCD panel 10.

The gate driver integrated circuit 140 receives the control signal (CS) from the timing controller 120 and the gate ON/OFF power ($V_{G\text{-}ON}$, $V_{G\text{-}OFF}$) from the DC/DC converter 130 and sequentially supplies a scan signal to the gate lines through the gate pad area 140 of the LCD panel 10.

The gamma voltage generator 160 may generate gamma voltages thereby creating a predetermined luminance value in accordance with the control signal (CS) received from the timing controller 120. The gamma voltage generator 160 then supplies the generated gamma voltages to the data driver IC 150. As mentioned above, the gamma voltage generator 160 may, for example, include a first gamma voltage generating circuit 162 for generating a general driving mode gamma voltage and a second gamma voltage generating circuit 163 for generating halftone gray driving mode gamma voltages.

The switching unit 170 may be provided between the data driver IC 150 and the gamma voltage generator 160, receive the control signal indicating the presence of the halftone gray driving mode or the general driving mode, and selectively activate the first and second gamma voltage generating circuits 162 and 163.

When the second gamma voltage generating circuit 163 is selected, the second gamma voltage generating circuit 163 may generate at least two gamma voltages and supply the generated gamma voltages to the data driver IC 150.

Upon receiving the image information and the control signal (CS) from the timing controller 120 and the gamma voltage ($V_{REF}$) from the gamma voltage generator 160, the data driver IC 150 supplies the image information to the data lines via the data pad area 150 of the LCD panel 10.

The LCD panel 10 displays the image information supplied via the data driver IC 150 upon receipt of the scan signal supplied through the gate driver IC 140.

According to the principles of the present invention, at least two gamma voltage generating circuits may be included within a gamma voltage generator. Accordingly, the gamma voltage generator may selectively drive pixels within an LCD panel according to a general driving mode or a halftone gray driving mode. Viewing angle characteristics of enlarged images may be improved by driving the LCD according to the halftone gray driving method.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel;

a gate pad area arranged at a periphery of the liquid crystal display panel;

a data pad area arranged at a periphery of the liquid crystal display panel;

a graphic processor for transmitting image information and a control signal;

an interface unit coupled to the graphic processor;

a timing controller for receiving the image information and the control signal from the graphic processor through the interface unit;

a DC/DC converter for transmitting a gate on/off power;

a gate driver integrated circuit for receiving the control signal and the gate on/off power and for supplying a scan signal to the gate pad area;

a data driver integrated circuit for receiving the image information and the control signal and for supplying the image information to the data pad area;

a first gamma voltage generator for supplying a first gamma voltage to the data driver integrated circuit driven according to a general driving mode; and a second gamma voltage generator for supplying a plurality of gamma voltages to the data driver integrated circuit driven according to a halftone gray driving mode.

2. The liquid crystal display of claim 1, further comprising:

a switching unit for receiving the control signal in accordance with the general driving mode and the halftone gray driving mode and for switching between the first gamma voltage generator and the second gamma voltage generator to selectively output one of the first gamma voltage and the plurality of gamma voltages.

3. The liquid crystal display of claim 1, wherein the plurality of gamma voltages generated from the second gamma voltage generator are supplied to the data driver integrated circuit for displaying enlarged images.

4. A liquid crystal display driving device, comprising:

a gate driver integrated circuit for supplying a scan signal to a plurality of gate lines;

a data driver integrated circuit for supplying image information to a plurality of data lines;

a first gamma voltage generator for supplying a first gamma voltage to the data driver integrated circuit when the liquid crystal display is driven according to a general driving mode, for generating an image having a first luminance value in a first predetermined pixel; and a second gamma voltage generator for generating an image having a plurality of second luminance values in a plurality of predetermined pixels corresponding to the first predetermined pixel when the liquid crystal display is driven according to a halftone gray driving mode and for supplying a plurality of gamma voltages to the data driver integrated circuit, wherein an average of the second luminance values is substantially the equal to the first luminance value.

5. The liquid crystal display driving device of claim 4, further comprising:

a switching unit for receiving a control signal in accordance with the general driving mode and the halftone gray driving mode and for switching between the first gamma voltage generator and the second gamma voltage generator for selectively outputting one of the first gamma voltage and the plurality of gamma voltages.

6. The liquid crystal display driving device of claim 4, wherein the second gamma voltage generator outputs a gamma voltage comprising at least one white grayscale level or black grayscale level.

7. A driving device, comprising:

a timing controller for transmitting a control signal indicating that a display device having a data driver be driven according to a general driving mode or a halftone driving mode;

a gamma voltage generator connected to the timing controller, the gamma voltage generator including a first gamma voltage generator for supplying a first gamma voltage type to the data driver according to the general driving mode and a second gamma voltage generator for supplying a second gamma voltage type to the data driver according to the halftone driving mode, wherein the halftone driving mode expresses a grayscale level using at least two different gamma voltages of the second gamma voltage type; and a switching unit connected to the timing controller and the gamma voltage generator for outputting one of the first and second gamma voltage types based on the control signal, wherein pixels receiving the first gamma voltage type are equivalently expressed as a pixel groups receiving the second gamma voltage type.

8. The driving device of claim 7, wherein a grayscale level generatable by the first gamma voltage type is equivalently expressed as at least two different grayscale levels generatable by a plurality of the second gamma voltage types.

9. The driving device of claim 7, wherein a luminance value of the pixels receiving the first gamma voltage type is substantially equal to an average luminance value of the pixel groups receiving the second gamma voltage type.

10. The driving device of claim 7, wherein a viewing angle of the pixels receiving the first gamma voltage type is less than the viewing angle of the pixel groups receiving the second gamma voltage type.

11. A method of driving a liquid crystal display device, comprising:

determining whether a liquid crystal display device is driven according to a general driving mode or a halftone gray driving mode;

supplying a first gamma voltage to a first pixel of the liquid crystal display device driven according to the general driving mode, wherein light is transmitted by the first pixel at a first luminance value; and supplying a plurality of gamma voltages to a plurality of pixels of the liquid crystal display device driven according to the halftone gray driving mode, wherein the plurality of pixels correspond to the first pixel, wherein an average luminance value by which light is transmitted by the plurality of pixels is substantially equal to the first luminance value.

12. The method of driving of claim 11, wherein the supplied plurality of gamma voltages comprises at least one or more white or black grayscale levels.

13. A driving method for a display device, comprising:

receiving a control signal;

generating one of a first gamma voltage type for a general driving mode and a second gamma voltage type for a halftone driving mode based on the received control signal, wherein the halftone driving mode expresses a grayscale level using at least two different gamma voltages of the second gamma voltage type; and outputting either the first gamma voltage type or the second gamma voltage type to the display device based on the received control signal, wherein pixels receiving the first gamma voltage type are equivalently expressed as pixels receiving the second gamma voltage type.

14. The driving method of claim 13, further comprising expressing a grayscale level generatable by first gamma voltage type equivalently as at least two different grayscale levels generatable by a plurality of the second gamma voltage types based on the received control signal.

15. The driving method of claim 13, further comprising enlarging an image displayable on a display and drivable with the first gamma voltage type using the second gamma voltage type based on the received control signal.

16. The driving method of claim 13, further comprising expressing a luminance value generated by the first gamma voltage type equivalently as at least two different grayscale levels generatable by a plurality of the second gamma voltage types based on the received control signal.

* * * * *